US008408153B2

(12) United States Patent
Montgomery

(10) Patent No.: US 8,408,153 B2
(45) Date of Patent: Apr. 2, 2013

(54) AUTOMATED MOORING METHOD AND MOORING SYSTEM

(75) Inventor: Peter James Montgomery, Kaiapoi (NZ)

(73) Assignee: Cavotec Moormaster Limited, Christchurch (NZ)

( * ) Notice: Subject to any disclaimer, the term of this patent is extended or adjusted under 35 U.S.C. 154(b) by 1 day.

(21) Appl. No.: 12/732,131

(22) Filed: Mar. 25, 2010

(65) Prior Publication Data

US 2010/0272517 A1 Oct. 28, 2010

Related U.S. Application Data

(63) Continuation-in-part of application No. PCT/NZ2008/000251, filed on Sep. 25, 2008, and a continuation-in-part of application No. PCT/NZ2008/000281, filed on Oct. 24, 2008.

(30) Foreign Application Priority Data

Sep. 26, 2007 (NZ) ..... 561995
Oct. 24, 2007 (NZ) ..... 562782

(51) Int. Cl.
*B63B 21/00* (2006.01)

(52) U.S. Cl. ..... 114/230.1; 114/230.17; 342/23; 405/218

(58) Field of Classification Search ..... 114/230.1, 114/230.15, 230.16, 230.17, 230.18, 230.19; 342/23, 42, 59; 441/3, 4, 5; 405/218
See application file for complete search history.

(56) References Cited

U.S. PATENT DOCUMENTS 3,227,481 A 1/1966 Creskoff
3,322,091 A 5/1967 Stanwick
3,463,114 A 8/1969 Lovell
3,707,717 A 12/1972 Frielinghaus
3,772,693 A * 11/1973 Allard et al. ..... 342/23
3,974,794 A 8/1976 Kakitani et al.
4,055,137 A 10/1977 Motai et al.
4,293,857 A 10/1981 Baldwin
4,532,879 A 8/1985 Ortloff
4,543,070 A 9/1985 Olsen et al.
4,549,835 A 10/1985 Ando et al.
(Continued)

FOREIGN PATENT DOCUMENTS

DE 1911949 10/1970
DE 25 57 964 12/1976
(Continued)

OTHER PUBLICATIONS

U.S. Appl. No. 12/485,830, filed Jun. 16, 2009, Montgomery et al., 2010-0012009, Office Action Jun. 30, 2010.

*Primary Examiner* — Lars A Olson
(74) *Attorney, Agent, or Firm* — Knobbe, Martens, Olson & Bear, LLP

(57) ABSTRACT

A mooring system for receiving and exercising at least partial control over the approach of a vessel approaching a mooring facility. An array of mooring robots are mounted to the mooring facility. Each robot has at least one vessel contact member supported by a moving mechanism in a manner to thereby be (i) movable relative to the mooring facility and (ii) presentable to engage the side of said vessel. A sensor can sense the position of the vessel relative the mooring facility. A processor can calculate movement instructions based on information received by the processor to calculate instructions for the movement of the contact member during the receipt of the vessel by the mooring system. A controller can preposition the contact member and then control the condition of each mooring robot such as to reduce the approach speed of the vessel at least in a direction towards the mooring facility.

53 Claims, 8 Drawing Sheets

U.S. PATENT DOCUMENTS

| | | | | |
|---|---|---|---|---|
| 4,852,926 | A | 8/1989 | Littell | |
| 5,154,561 | A | 10/1992 | Lee | |
| 5,274,378 | A | 12/1993 | O'Conner | |
| 5,432,515 | A | 7/1995 | O'Conner | |
| 5,676,085 | A | 10/1997 | Michl, Jr. | |
| 5,969,665 | A | 10/1999 | Yufa | |
| 6,023,665 | A | 2/2000 | Millgard | |
| 6,439,147 | B2 | 8/2002 | Cottrell et al. | |
| 6,826,452 | B1 * | 11/2004 | Holland et al. | 700/245 |
| 6,910,435 | B2 | 6/2005 | Hadcroft et al. | |
| 6,938,570 | B2 | 9/2005 | Montgomery et al. | |
| 7,055,448 | B2 | 6/2006 | Hadcroft et al. | |
| 7,293,519 | B2 | 11/2007 | Montgomery et al. | |
| 7,673,577 | B2 * | 3/2010 | Poldervaart et al. | 114/230.1 |
| 2001/0029879 | A1 | 10/2001 | Cottrell et al. | |
| 2004/0154518 | A1 | 8/2004 | Hadcroft et al. | |
| 2005/0087118 | A1 | 4/2005 | Hadcroft | |
| 2006/0081166 | A1 | 4/2006 | Montgomery | |
| 2008/0156244 | A1 | 7/2008 | Montgomery et al. | |
| 2010/0012009 | A1 | 1/2010 | Montgomery | |

FOREIGN PATENT DOCUMENTS

| | | | |
|---|---|---|---|
| DE | 92 07 648.3 | | 1/1992 |
| DE | 4301637 | | 5/1997 |
| FR | 2 672 650 | | 8/1992 |
| GB | 1 491 511 | | 11/1977 |
| GB | 2 388 356 | | 1/2004 |
| JP | 55-44057 | | 3/1980 |
| JP | 58-206478 | | 12/1983 |
| JP | 61-218495 | | 9/1986 |
| JP | 04303706 | | 10/1992 |
| JP | 07033075 | A | 2/1995 |
| JP | 08034388 | A | 2/1996 |
| JP | 2000292540 | | 10/2000 |
| NL | 8600973 | | 11/1987 |
| NZ | 520450 | | 7/2002 |
| WO | WO 91/14615 | | 10/1991 |
| WO | WO 96/12265 | | 4/1996 |
| WO | WO 98/17868 | | 4/1998 |
| WO | WO 01/62584 | | 8/2001 |
| WO | WO 01/62585 | | 8/2001 |
| WO | WO 02/090176 | | 11/2002 |
| WO | WO 2004/011326 | | 2/2004 |
| WO | WO 2004/076273 | | 9/2004 |
| WO | WO 2005/097590 | | 10/2005 |
| WO | WO 2006/006879 | | 1/2006 |

* cited by examiner

AUTOMATED MOORING METHOD AND MOORING SYSTEM

CROSS-REFERENCE TO RELATED APPLICATIONS

This application is a continuation-in-part of PCT/NZ2008/000251 filed Sep. 25, 2008 which claims the benefit of NZ 561995 filed Sep. 26, 2007 and this application is also a continuation-in-part of PCT/NZ2008/000281 filed Oct. 24, 2008 which claims the benefit of NZ 562782 filed Oct. 24, 2007 which are hereby incorporated in their entirety herein.

FIELD OF THE INVENTION

The present invention relates to a mooring system for receiving and mooring a vessel and related method of mooring a vessel.

BACKGROUND

Ships and similar vessels are moored in ports everyday around the world. When a ship is moored at a terminal this usually involves guiding the ship in towards the terminal at a low speed. Tugs are often used to assist this. However, even at such low speeds, the large mass of a ship creates a high inertia. This can result in damage to either the terminal or the ship or both. For this reason buffer elements, commonly known as fenders, are used to provide a resilient shock absorbing interface for absorbing the energy of an approaching vessel.

Examples of fenders include large tyres, rubber bricks, timber cladding, and the like. Typically, once a ship has been moored at a terminal, it is held against the fenders to prevent it from moving around under the forces of wind, tides and any swell.

Mooring robots are known for use in mooring ships to terminals. PCT publication WO 2002/090176 entitled "Mooring Robot", which is incorporated herein by reference, discloses a mooring robot including suction cups for engagement with the freeboard of a ship. The mooring robot can position the suction cups within a 3-dimensional operating envelope. An arm linkage is provided for extending and retracting the suction cups in the transverse direction. Using such mooring robots, a ship can be secured to a terminal and external forces acting on the ship can be counteracted by the mooring robots, at least so some extent. However, in order for the suction cups on such a mooring robot to engage and hold the ship, the ship must be in a relatively stable position, and must have been brought within the range of movement of the suction cups.

If a ship is moving towards the terminal quickly, or if it is oscillating significantly (such as due to the external forces mentioned above) difficulties can arise in engaging of the ship with a suction cup.

As shipping lanes and ports become more congested, it would be advantageous to be able to provide automation of the mooring of commercial and passenger shipping in order to streamline the process and potentially reduce the time that a ship is moored at the terminal. This could offer the advantage of increased utilisation of the terminal.

Further, as commercial shipping increases, so do the size of commercial ships. One effect of this is that these ships become more difficult to control during the mooring process, since it is not always immediately apparent to the captain or pilot of such a ship where the ship is in relation to the terminal to be moored at. Nor how a particular ship reacts during the mooring process, to the external forces acting on the ship.

Additionally, prevailing weather and tide conditions may make the mooring of large commercial ships difficult and possibly dangerous. Large forces that a ship can exert on objects around it, can for example result in damage to the mooring terminal and/or the mooring robots.

It may be an object of the present invention to provide a mooring system and/or method of mooring a vessel which overcomes or at least ameliorates some of the above mentioned disadvantages, or which at least provides the public with a useful choice.

It may also be an object of the present invention to provide a mooring system and related method that can determine the position and/or velocity of an incoming vessel to allow for a mooring device to be controlled to reduce the likelihood of damage from incorrect operation and/or excessive or undesirable vessel velocities and/or to at least provide the public with a useful choice.

In this specification, where reference has been made to external sources of information, including patent specifications and other documents, this is generally for the purpose of providing a context for discussing the features of the present invention. Unless stated otherwise, reference to such sources of information is not to be construed, in any jurisdiction, as an admission that such sources of information are prior art or form part of the common general knowledge in the art.

BRIEF DESCRIPTION OF THE INVENTION

In a first aspect the present invention consists in a mooring system, suitable for mooring an approaching vessel at a terminal by at least one mooring facility mounted mooring robot that includes an engaging mechanism actuatable to engage with a vessel and a moving mechanism for moving the engaging mechanism relative to said mooring facility, said mooring system comprising;

a) a location sensing system suitable for sensing the location of a vessel and generating a location signal corresponding to the sensed location of the vessel, and b) movement calculating instructions for instructing a processor to use the generated location signal for calculating an index indicative of the movement required of at least one mooring robot in order to engage the engaging mechanism of said at least one mooring robot with the vessel without causing significant initial change in inertia of the vessel.

Preferably the movement calculating instructions are also for calculating an index indicative of the movement required of at least one mooring robot in order to stop the moving vessel without a sudden deceleration in at least a direction of movement of the vessel towards the mooring facility.

Preferably the mooring system includes movement directing instructions configured for directing a control system to control the movement of said at least one mooring robot in accordance with the calculated index(es).

Preferably the movement directing instructions are configured for directing at least one mooring robot to extend the engaging mechanism away from the mooring facility and towards the approaching vessel, and then retract the engaging mechanism towards the mooring facility at a velocity smaller than the velocity of the approaching vessel in that direction so that the vessel makes initial contact with the mooring robot in a manner that is not damaging to the vessel and/or mooring robot.

Preferably the movement directing instructions are configured for directing a plurality of mooring robots of the mooring system that are arranged in an array at said mooring facility.

Preferably the movement directing instructions are configured for directing a plurality of mooring robots to provide an optimised array configuration for absorbing the kinetic energy of an approaching vessel in a manner that is not damaging to the vessel and/or mooring robot.

Preferably the optimised array configuration includes the arrangement of the engaging mechanisms of the each mooring robot such that they all engaged with the vessel simultaneously.

Preferably the optimised array configuration includes the arrangement of the engaging mechanisms of the each mooring robot such that they all engaged with the vessel non-simultaneously and preferably sequentially.

Preferably the mooring robots are positioned in a linear array relative the mooring terminal and the optimised array configuration includes the arrangement of the engaging mechanisms in a manner that results in not all engaging simultaneously with the vessel when the vessel, having a port or starboard side, is approaching the array with the port or starboard sides not parallel to the array.

Preferably the movement directing instructions are configured for directing at least one mooring robot to engage with and interact with the vessel to reduce its kinetic energy.

Preferably the moving mechanism includes at least one hydraulic cylinder, and kinetic energy of the approaching vessel is reduced by the flow of fluid through the hydraulic cylinder.

Preferably the mooring system includes a control system for controlling movement of the moving mechanism in accordance with that directed by the movement directing instructions.

Preferably the mooring system includes a processor for performing calculations.

Preferably the mooring system includes at least one storage means for storing the movement calculating instructions or movement directing instructions or both.

Preferably the mooring system includes a transceiver for receiving and transmitting signals.

Preferably the location sensing system includes at least one Global Positioning System (GPS).

Preferably the location sensing system includes at least one localised distance sensing system and/or a localised positioning system.

Preferably the localised distance sensing system includes a distance sensor fixed relative to one of the mooring robot and mooring facility.

Preferably the mooring system includes at least one mooring robot.

Preferably the mooring system includes a plurality of mooring robots.

Preferably the control system controls each of the plurality of mooring robots to be controlled independently of each other.

Preferably the control system controls each of the plurality of mooring robots to be controlled independently of each other but operate in concert with each other.

Preferably one or more selected from the movement calculating instructions and the movement directing instructions is configured to receive information relating to the characteristics of the vessel to be moored.

Preferably the characteristics are one or more selected from unladen weight, laden weight, length, and any other characteristic of the vessel.

Preferably the mooring system is configured to receive information about characteristics of the vessel from the vessel's Automatic Identification System.

Preferably one or more selected from the movement calculating instructions and the movement directing instructions utilises the location signal to direct the processor to calculate an index indicative of one or more selected from;

a) the velocity of the vessel relative to the terminal, b) the acceleration or deceleration of the vessel, c) the kinetic energy of the vessel, and d) the inertia of the vessel.

Preferably the mooring system includes at least one emergency buffer element suitable for absorbing the energy of an approaching vessel with kinetic energy which is in excess of that absorbable by the mooring robots in a direction toward the mooring facility, thereby to provide additional protection for the vessel, mooring facility an/or mooring robot.

Preferably the emergency buffer element is moveable between a non-deployed position in which it cannot contact the vessel and a deployed position in which the buffer element can contact the vessel, whether or not the engaging mechanism is also capable of engaging the vessel.

Preferably the emergency buffer element is normally retained in the non-deployed position, and moves automatically to its deployed position upon detection, via the position sensor(s) and/or the mooring robots, that the vessel's kinetic energy is greater than what can be absorbed by the mooring robot(s).

Preferably the mooring system includes a plurality of emergency buffer elements.

Preferably, when one or more of the calculated kinetic energy and inertia of an approaching vessel in at least a direction towards the mooring facility is above the energy absorption capability of the mooring robot or mooring robots when acting in concert, the movement directing instructions are configured for directing the mooring robot(s) absorb as much energy of the approaching vessel as possible without being damaged, before withdrawing to a protected position in which the mooring robots are shielded from damage by the vessel by the buffer elements.

Preferably the mooring system is configurable between an activated state in which the location sensing system of the system is operable to detect the location of an approaching moving vessel and control the mooring robot(s) in response to the detected location of the vessel, and a deactivated state in which the location sensing system is not operable.

Preferably the control system is configurable to actuate the engaging mechanism to engage with and secure the vessel to the terminal via the mooring robot(s) once the vessel has been moored.

Preferably the control system is configurable to actuate the engaging mechanism to engage with and secure the vessel to the terminal via the mooring robot(s), and to move the vessel to a predetermined configuration relative to the terminal once the vessel has stopped moving during initial mooring of the vessel.

Preferably the control system is configurable to actuate the engaging mechanism to engage with and secure the vessel to the terminal via the mooring robot(s) during initial mooring of the vessel to then exercise some control over the speed of the vessel in a direction towards the mooring facility and a horizontal direction perpendicular thereto.

Preferably the control system is configurable to actuate the engaging mechanism to engage with and secure the vessel to the terminal via the mooring robot(s), and to move the vessel to a predetermined distance relative to the terminal once the vessel has stopped moving during initial mooring of the vessel.

Preferably the mooring system uses information received from the Automatic Identification Systems (AIS) of individual vessels to identify the approaching vessel and determine relevant information relating to that vessel, such as weight, size, and the like.

Preferably the mooring system uses information received from the Automatic Identification Systems (AIS) of individual vessels to identify the approaching vessel and determine relevant information relating to that vessel, such as weight, size, for use in one or more selected from;

a) calculating an index indicative of the movement required of the mooring robot in order to engage the engaging mechanism with the vessel without causing significant initial change in inertia of the vessel;

b) calculating an index indicative of the movement required of the mooring robot in order to further stop the moving vessel without it undergoing a sudden deceleration; and c) activating the mooring system to its active state.

Preferably the engaging mechanism of the mooring robots includes a suction cup in fluid communication with a suction source, which allows the suction cup to attach to the hull of the vessel by suction force.

Preferably the engaging mechanism includes a protective member for protecting the suction cup form abrasion against the vessel when the engaging mechanism engages with the vessel during initial mooring of the vessel.

Preferably the protective member is moveable between a protective position in which the suction cup is protected from abrasion by the vessel, and a retracted position in which the suction cup can engage and secure with the vessel.

Preferably the moving mechanism includes at least one moveable arm linkage located intermediate of a foundation of the mooring robot that is mounted to the mooring facility and the engaging mechanism.

Preferably the moving mechanism allows controlled movement of the securing mechanism relative to the mooring facility.

In another aspect the present invention consists in a method of mooring a vessel utilising at least one mooring facility mounted mooring robot that comprising an engaging mechanism for engaging with the side of a vessel approaching a mooring facility, and a moving mechanism for moving the engaging mechanism, said method comprising the steps of;

a) measuring the location of a vessel relative to a terminal by way of a location sensing system;

b) calculating an index value associated with the movement required by the mooring robot to engage the engaging mechanism with the vessel without causing significant initial change in inertia of the vessel; and c) controlling movement of the mooring robot in accordance with the calculated movement.

Preferably the method includes the step of calculating an index indicative of the movement required of the mooring robot in order to slow the movement of the vessel towards the mooring facility, preferably without a sudden deceleration thereby preventing damaging collision of the vessel with the mooring facility.

Preferably the method includes the steps of directing a controller to control movement a mooring robot in accordance with the calculated index to bring the vessel to a stop without a sudden deceleration.

Preferably the method includes the step of activating the location sensing system to sensitise it to the approach of a vessel.

Preferably the step of activating the location sensing system is carried out automatically by the Automatic Identification System (AIS) of the vessel.

Preferably the method includes the step of calculating an index indicative of the kinetic energy of the approaching vessel at least in a direction acting towards the mooring facility.

Preferably the method includes the step of deploying an emergency buffer element in response to the calculated index indicative of the kinetic energy of an approaching vessel exceeding a certain limit, thereby to protect one or more of the vessel, the mooring facility and the mooring robot.

Preferably the method includes the steps of extending at least part of engaging mechanism towards the approaching vessel, and then retracting the extended part at a velocity that is slower than the approaching vessel, thereby causing the approaching vessel to engage with the extended part without causing impact damage to the mooring robot and/or the vessel.

In another aspect the present invention consists in a method of operating a mooring system suitable for receiving a vessel that is approaching a mooring facility that includes a plurality of mooring robots mounted to a mooring facility, said mooring robots including an engaging mechanism for engaging with the side of a vessel and a moving mechanism for moving the engaging mechanism relative the mooring facility, said mooring robots forming part of a system that comprises;

a) a location sensing system suitable for sensing the location of and/or part of the vessel relative to the mooring facility and/or each of the mooring robots and/or each of the engaging mechanisms, b) and a processor for calculating movement required by the engaging mechanism of each mooring robot, and c) a controller to control movement of the mooring robots in response to information received from the processor, said method comprising the steps of;

d) providing movement calculating instructions for instructing the processor to use a generated location signal for calculating the movement required of each mooring robot in order to engage the engaging mechanism with the vessel without causing damage to the mooring robot and/or vessel; and e) configuring the instructions to direct the processor to use a generated location signal for calculating the movement required of the mooring robot in order to result in the engaging mechanism contacting with the vessel in a manner to avoid causing damage to the mooring robot and/or vessel.

In another aspect the present invention consists in a method of mooring a vessel utilising at least one mooring facility mounted mooring robot that comprising an engaging mechanism for engaging with the side of a vessel approaching a mooring facility, and a moving mechanism for moving the engaging mechanism, said method comprising the steps of;

measuring the location of a vessel relative to a terminal by way of a location sensing system;

calculating an index value associated with the movement required by the mooring robot to engage the engaging mechanism with the vessel in a condition to allow control of movement of the mooring robot to reduce the kinetic energy of the vessel in at least a direction acting towards the mooring facility by the mooring robot.

In another aspect the present invention consists in a mooring system for receiving and exercising at least partial control over the approach velocity of a vessel approaching a mooring facility, said system comprising;

an array of mooring robots mounted to the mooring facility, each mooring robot including a base that is secured to the mooring facility and at least one vessel contact member supported by a moving mechanism in a manner to thereby be (i)

movable relative to the mooring facility and (ii) presentable to engage the side of said vessel, at least one sensor to sense the position of the vessel relative the mooring facility, a processor to receive information from the sensor about the location of the vessel, said processor capable of calculating movement instructions based on information received by the processor to calculate instructions for the movement of the contact member of each mooring robot during the receipt of the vessel by the mooring system, a controller to (i) control the condition of each mooring robot to position their respective contact members in a position, prior contact with the vessel, in a manner where the mooring robot can reduce the approach speed of the vessel at least in a direction towards the mooring facility, and (ii) control the condition of each mooring robot to position their respective contact members in a position, during contact with the vessel, to reduce the approach speed of the vessel at least in a direction towards the mooring facility.

Preferably the base is secured to the mooring facility in a permanent and fixed manner.

Preferably the base is secured to the mooring facility in a movable manner.

Preferably the information received by the processor includes information from generated by the sensor about the position of the vessel.

Preferably the information received by the processor includes the laden weight of the vessel approaching.

Preferably the at least one contact member is a suction cup, that with suction establishable between the vessel and the suction cup can secure a mooring robot with the vessel.

Preferably a second contact member is provided that can contact but can not secure with the vessel, the second contact member being movable relative to the suction cup to (i) be positioned in a manner to prevent the suction cup from engaging the vessel during receipt of the vessel, and (ii) be positioned in a manner to allow the suction cup to engage and become fastened to the vessel after initial receipt.

Preferably the moving mechanism includes at least one hydraulic cylinder via which the force of the vessel applied via the contact member can at least in part be absorbed.

In another aspect the present invention consists in a mooring system for securing a vessel approaching a mooring facility said system comprising;

a linear array of mooring robots mounted to the mooring facility, each mooring robot including a base that is secured to the mooring facility in a movable manner relative thereto and at least one suction cup supported by a moving mechanism in a manner to thereby be (i) movable relative to the mooring facility and (ii) presentable to engage to the side of said vessel, at least one sensor to sense the position of the vessel relative the mooring facility, a processor to receive information from the sensor about the location of the vessel, said processor capable of calculating movement instructions based on information received by the processor to calculate instructions for the movement of mooring robots in the array, a controller to control the position of the mooring robots relative to the mooring facility and relative to each other to control the number of the mooring robots of the array that are positioned in a location make contact with the approaching vessel.

In another aspect the present invention consists in a mooring facility that includes a mooring system as herein described.

In another aspect the present invention consists in a wharf that includes a plurality of wharf mounted mooring robots positioned in a linear array and that each include a suction cup moveably mounted relative the wharf for contacting and securing to a side of a vessel adjacent the wharf to hold the vessel adjacent the wharf, said suction cups controllable to be positioned for simultaneous engagement with an approaching vessel, including when the side of the vessel is not completely parallel to the linear array.

In another aspect the present invention consists in a wharf that includes a plurality of wharf mounted mooring robots positioned in a linear array and that each includes a suction cup moveably mounted relative the wharf for contacting and securing to a side of a vessel adjacent the wharf to hold the vessel adjacent the wharf, said suction cups controllable to be positioned for engagement with an approaching vessel, including, when the side of the vessel is not completely parallel to the linear array, in a non simultaneous manner.

Preferably the sensing system includes sensor(s), the sensor(s) provide position information on an approaching vessel and/or part or parts of the vessel, from which the system can calculate the velocity of the vessel and/or part or parts of the vessel.

Preferably the at least one sensor can detect or allow the derivation of one or more of:

the position and/or velocity of the bow of a vessel, the position and/or velocity of the stern of a vessel, the position and/or velocity of the hull of a vessel, and the athwartship position or velocity of a vessel, relative at least one of the mooring facility and the hull coupler of the or each mooring device.

Preferably the sensor(s) can be used to derive information on the change in velocity of the vessel or part of the vessel.

Preferably further comprising an output device for outputting, based on the location signal, a) visual information indicating the velocity and/or position of the proximate vessel and/or part(s) of the vessel relative to at least one of the mooring facility and the at least one mooring robot, b) a graphical representation of the proximate vessel indicating the velocity and/or position of the vessel and/or part(s) of the vessel, c) an audible or visual warning if the velocity of the proximate vessel or part of the vessel exceeds a threshold.

Preferably said method, comprising:

a) determining the position and/or velocity and/or change in velocity of one or more of the (a) bow, (b) stern, (c) hull, (d) part of the hull at where the engaging mechanism is to engage, of an approaching vessel, and the method further comprising, based on what is sensed, at least one of i. providing a warning for a mooring facility operator if the vessel's approach to the mooring facility exceed a predetermined threshold, ii. providing visual and/or audible information indicating the velocity and/or change in velocity and/or position of a vessel or part or parts of the vessel relative at least one of the mooring facility and the engaging mechanism of the or each mooring robot, iii. operating one or more mooring robots to alter the position of a respective engaging mechanism to at least partially adjust for the position and/or velocity of an approaching vessel.

Preferably information is provided indicative of the velocity and/or position of an approaching vessel to an operator to allow them to decide to (i) operate the mooring robots to secure the vessel, or (ii) to operate (or not) the mooring robot to prevent the vessel being secured.

Preferably information is provided as graphical representation and will also include a warning (visual and/or audible) if the vessel's approach to the mooring facility exceed a predetermined threshold.

In another aspect the present invention consists in a mooring system for securing a vessel to a mooring facility, said mooring system comprising:

a) at least one mooring robot for installation at a mooring facility in a position to allow the mooring robot to assist in holding a vessel relative to the mooring facility, each robot comprising an engaging mechanism moveably supported relative the mooring facility by a moving mechanism, b) at least one position and/or velocity sensor, for sensing position and/or velocity of a proximate vessel and/or part of the vessel that is or is to be held by the mooring robot relative the mooring facility, relative to the mooring facility and/or the engaging mechanism of said at least one mooring robot, and c) a controller to at least control the at least one mooring robot based on information received from or derived from the sensor.

Preferably the controller can control the moving mechanism of at least one mooring robot to alter the position and/or velocity of the respective engaging mechanism of the mooring robot relative to the mooring facility, when not coupled to the vessel in a manner to at least partially adjust for the position and/or velocity of an approaching vessel.

Preferably the controller can control the moving mechanism, in response to said information, automatically or under human control.

Preferably at least two mooring robots are provided to be located at spaced apart locations at the mooring facility, and wherein at least one sensor is provided to determine the location and/or velocity of a location of those parts of the proximate vessel that is most proximate each engaging mechanism of the at least two mooring robots.

Preferably the controller can control the moving mechanism of each mooring robot to allow the position and/or velocity of the engaging mechanism of a respective mooring robot to be changed relative to the mooring facility in response to location and/or velocity information sensed by the at least one sensor.

Preferably the engaging mechanism can be controlled so that at initial contact thereof with the proximate vessel the velocity of the engaging mechanism relative the mooring facility is such as to reduce the impact of initial contact between the hull and the engaging mechanism when compared to if the engaging mechanism is held stationary relative the mooring facility.

Preferably the controller can control the velocity of the engaging mechanism in response to the information sensed by the at least one sensor.

Preferably the controller can control the position of the engaging mechanism in response to the information sensed by the at least one sensor.

Preferably the controller can position the engaging mechanism in a position relative said mooring facility such that at the instance of initial contact with the hull of the proximate vessel during the coupling of the vessel with the mooring robot, the moving mechanism is in a condition to allow it to move in a manner to facilitate the movement of the engaging mechanism, when coupled to the vessel, in a direction that that part of the vessel with which it is engaged, is moving upon the initial contact.

Preferably, wherein the position that the controller moves the engaging mechanism to, is one that provides for the maximum distance of travel to be provided for, for the hull coupler, by the moving mechanism.

Preferably the moving mechanism of each mooring robot is operable to move, relative to the mooring facility, the respective engaging mechanism up and down and horizontally towards and way from an approaching vessel.

Preferably the engaging mechanism includes a suction pad.

Other aspects of the invention may become apparent from the following description which is given by way of example only and with reference to the accompanying drawings.

As used herein the term "and/or" means "and" or "or", or both.

As used herein "(s)" following a noun means the plural and/or singular forms of the noun.

The term "comprising" as used in this specification and claims means "consisting at least in part of". When interpreting statements in this specification and claims which include that term, the features, prefaced by that term in each statement, all need to be present but other features can also be present. Related terms such as "comprise" and "comprised" are to be interpreted in the same manner.

The entire disclosures of all applications, patents and publications, cited above and below, if any, are hereby incorporated by reference.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

The invention will now be described by way of example only and with reference to the drawings in which.

DETAILED DESCRIPTION OF THE INVENTION

Figure 1:
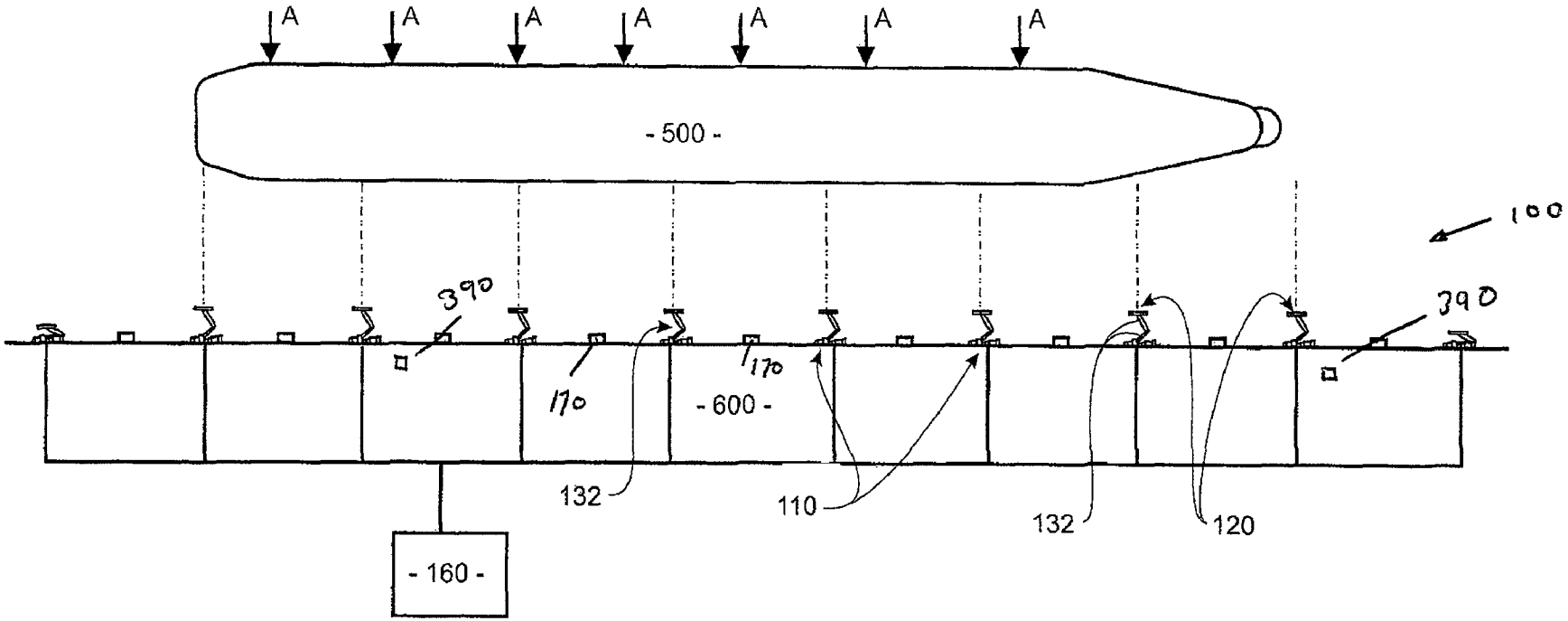
FIG. 1 shows a vessel approaching the terminal in direction shown by arrows before engaging with the mooring robots.

With reference to the above drawings, a mooring system is generally indicated by the numeral 100.

The mooring system 100 is suitable for receiving and holding a vessel 500 at a terminal 600 by means of a plurality of mooring robots 110.

Figure 4:
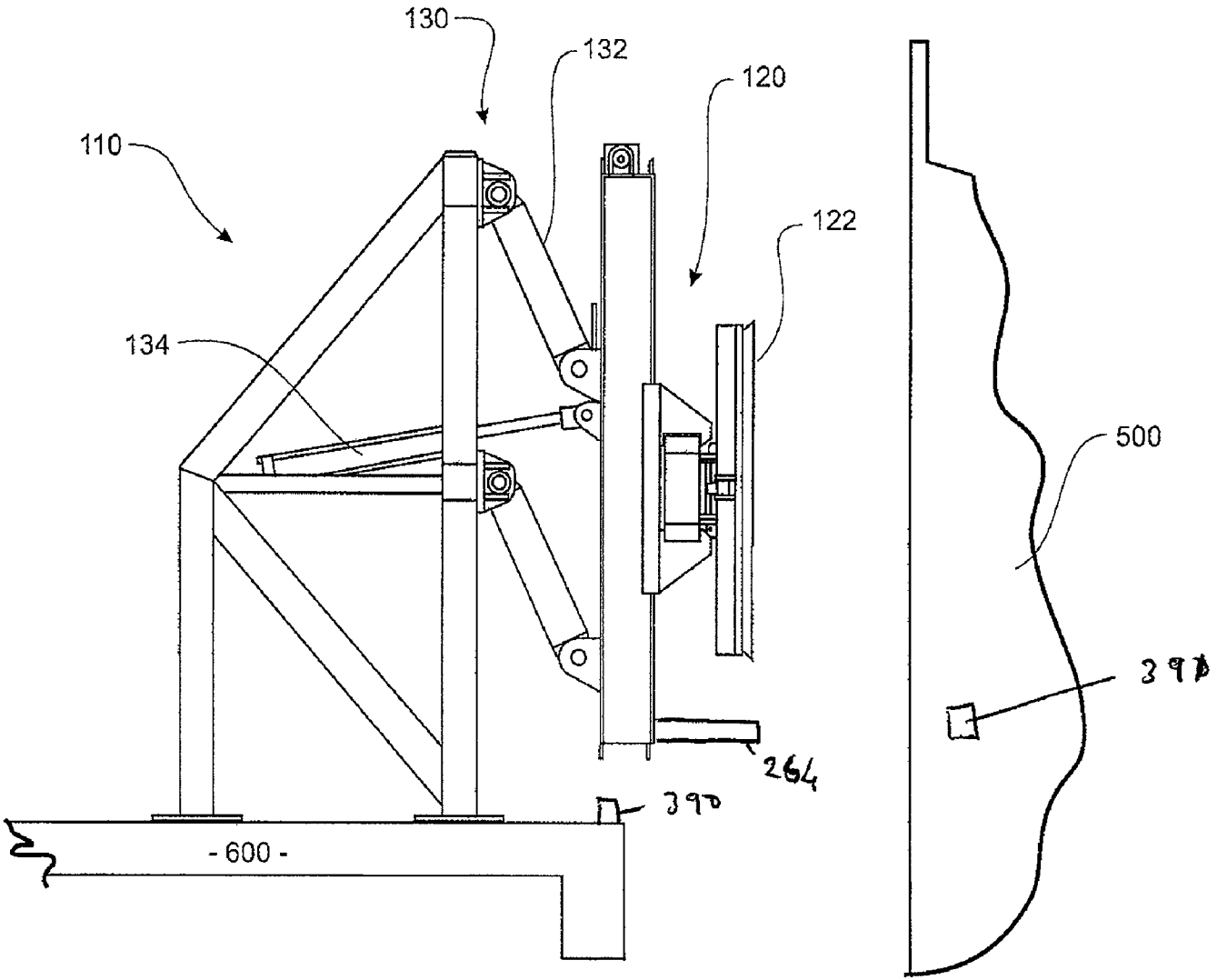
FIG. 4 shows a side view of a known mooring robot.

With reference to an example shown in FIG. 4, the mooring robots 110 include an engaging mechanism 120. This may include a suction cup 122 and associated suction source, which is operable to secure the suction cups against a vessel 500 by suction. The suction is sufficient to create a pressure differential to the ambient air pressure in order for the suction cups to secure to the vessel.

The mooring robot shown in FIG. 4 shows a moving mechanism 130 that includes arm linkages 132 to move the suction cups. It is envisaged that the arm linkages 132 can be telescopic and/or articulated and are moveable by a plurality of hydraulic cylinders 134. Motors and gears may be used also. This mechanism allows for the suction cup to be moveable relative the terminal in two and preferably in three dimensions. The moving mechanism 130 may move the engaging mechanism 120 within an envelope to where it is required or desired. This can allow the mooring robot to exert control (alone or in concert with other mooring robots) over a vessel 500 that comes into contact and/or is engaged with and/or secured to the engaging mechanism 120.

Figure 7:
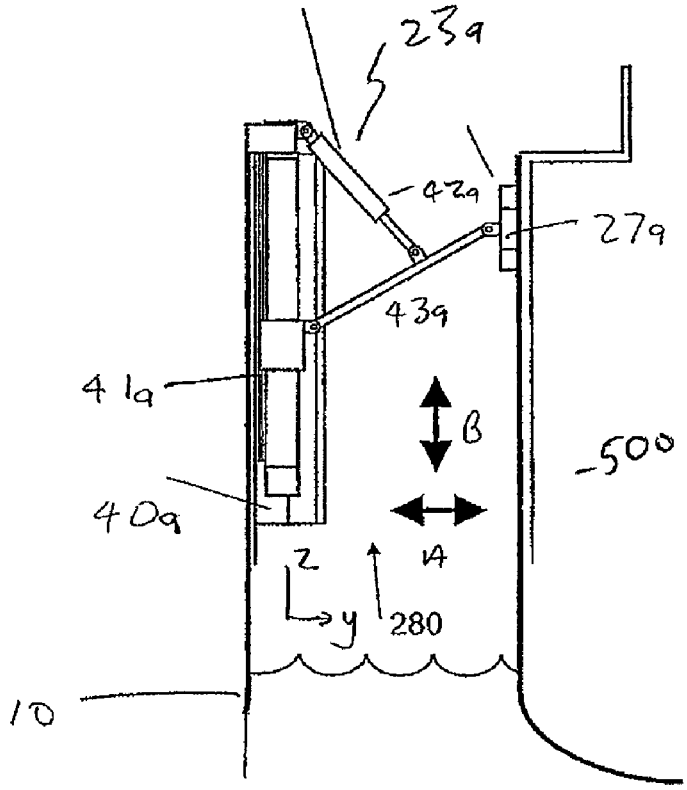
FIG. 7 shows a side elevation view of a mooring device arranged on a mooring facility in accordance with one embodiment of the invention.
Figure 8:
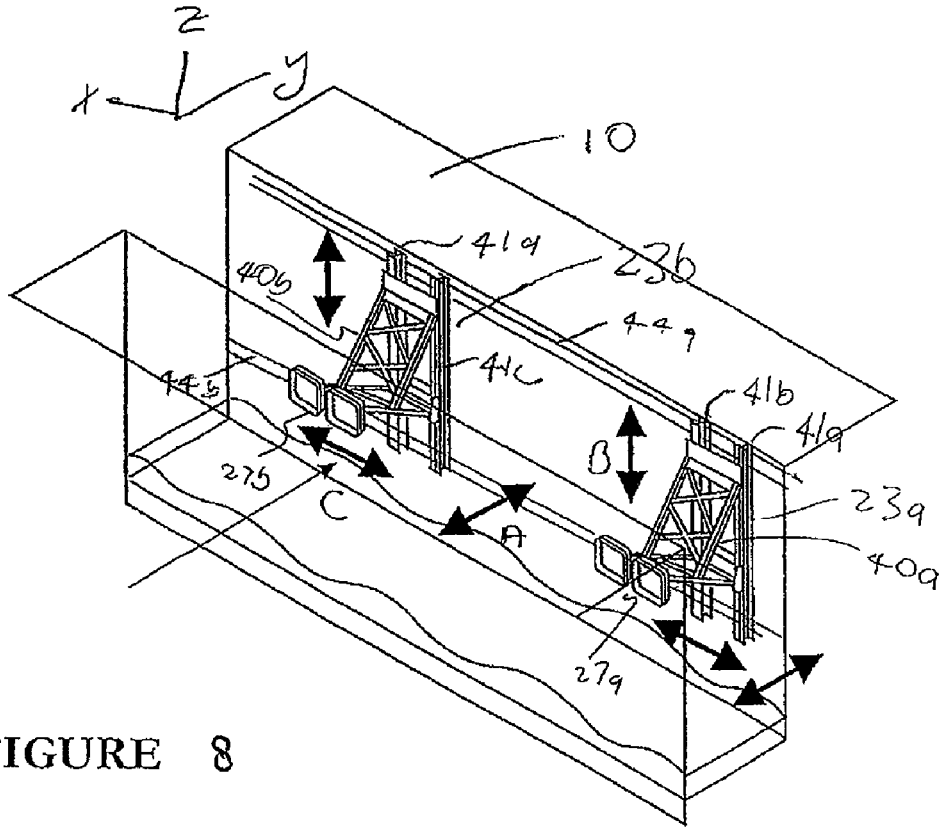
FIG. 8 shows a perspective view of two mooring devices arranged on a mooring facility according to one embodiment in perspective.

FIGS. 7 and 8 show another example of mooring robots. Each mooring robot 23*a*-23*b* comprises a moving mechanism that supports one or more suction cups. A side elevation of a single mooring device, e.g. 23*a*, is shown in FIG. 7. Two mooring robots are shown in FIG. 8. Each robot is operable to enable the respective suction cup(s) to move:

a) towards and away from the approaching vessel in the y direction (arrow A), b) up and down relative to the water in the z direction (arrow B), and also c) side-to-side longitudinally along the mooring facility in the x direction (arrow C).

Movement in these directions may occur simultaneously or not.

Each mooring robot may comprise a frame e.g. 40*a*, 40*b* with two sets of two struts respectively, e.g. struts 42*a*-42*d* and 43*a*-43*d*, one set positioned either side of the frame 40*a*, 40*b*. In each set, the first strut 42*a*-42*d* can be hydraulically controlled and can pivotally adjust the second strut 43*a*-43*d* to adjust the position of the suction cup in both the z and y directions. A suction cup may also be pivotally attached to each second strut, meaning in the preferred embodiment there are two suction cups for each mooring robot. The term suction cup can refer to each cup alone or each pair of cups e.g. 27*a*.

Further, each frame 40*a*, 40*b* is slidingly coupled to a respective set of rails 41*a*, 41*b*, and 41*c*, 41*d* that enables the entire frame 40*a*, 40*b*, including the suction cups(s) to slide up and down in a vertical (z) direction (arrow B). The combined actions of the struts 42*a*-42*d*, 43*a*-43*d* together the rails 41*a*-41*d* enables controlled movement of each suction cup in the z and y direction.

Further, for each mooring robot, the respective frame 40*a*, 40*b* and the vertical rails 41*a*-41*d* are placed on horizontal rails 44*a*, 44*b* that run along the extent of (or at least partially thereof) the mooring facility 10 in the x direction. This allows movement of the suction cups in the x direction. As shown, several mooring robots 23*a*, 23*b* might share the same rail. Alternatively, they can have separate rails.

The provision of the struts and the rails enable movement of the suction cups in any of the x, y, z directions. This can be through passive movement under the influence of vessel movement or by active control. That is, through hydraulics and control by a controller, the mooring robots may be operated to move the struts and/or frame on the rails to position the suction cups in any position within an envelope.

The mooring system 100 may further comprise a sensing system suitable for helping determine the location and/or approach velocity of an approaching vessel 500.

It is envisaged that the sensing system can include one or more sensors. Such may include a Global Positioning System Unit (GPS) 391 on board the vessel. This can transmit information or signal corresponding to the location and/or velocity and/or change in velocity of the vessel 500 and/or parts of the vessel 500 from the vessel 500 to other parts of the system.

Alternatively, or in addition, it is envisaged that the sensing system could include a sensor 390 fixed relative the terminal or part of a or each mooring robot. Such a sensor(s) may be a laser, infrared beam, radar, optical, sonic, or ultrasound distance sensor(s). Parts of the sensing system could be based ashore and parts could be on the vessel. The sensors may be of a kind to output distance information, velocity information and/or acceleration information or information to allow such to be determined.

The mooring system 100 may also use information from or derived from systems such as Automatic Identification Systems (AIS) to identify the approaching vessel 500, and to obtain relevant information about that vessel 500, such as its loaded and unloaded weight, load distribution, size, shape and mass and the like.

It is envisaged that in one embodiment, the relative distance to and direction of travel and speed of the approaching vessel and/or parts of the vessel sensed by the sensing system can be transmitted to and/or be calculated by a control system 160.

The control system preferably controls the mooring robots. It may also provide for output of information for visual communication or audio.

Figure 2:
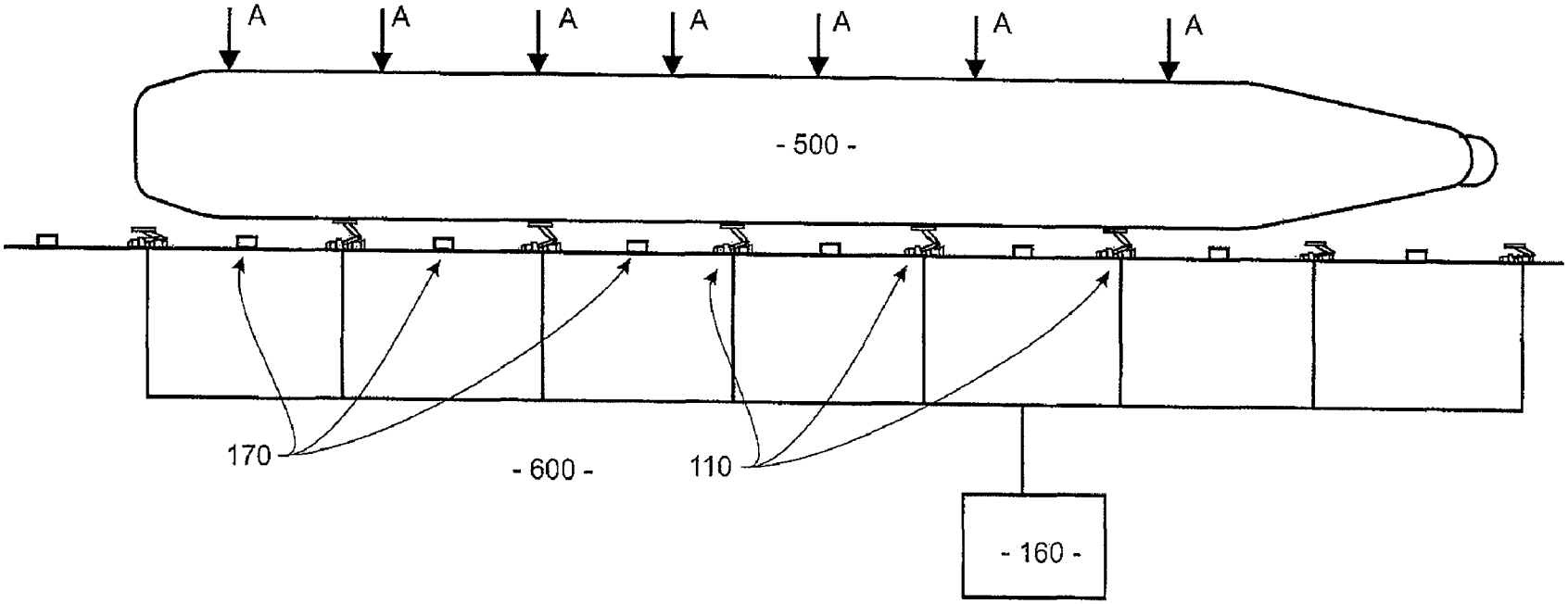
FIG. 2 shows the vessel having engaged with the mooring robots, and the mooring robots in the process of slowing the velocity of the vessel.
Figure 3:
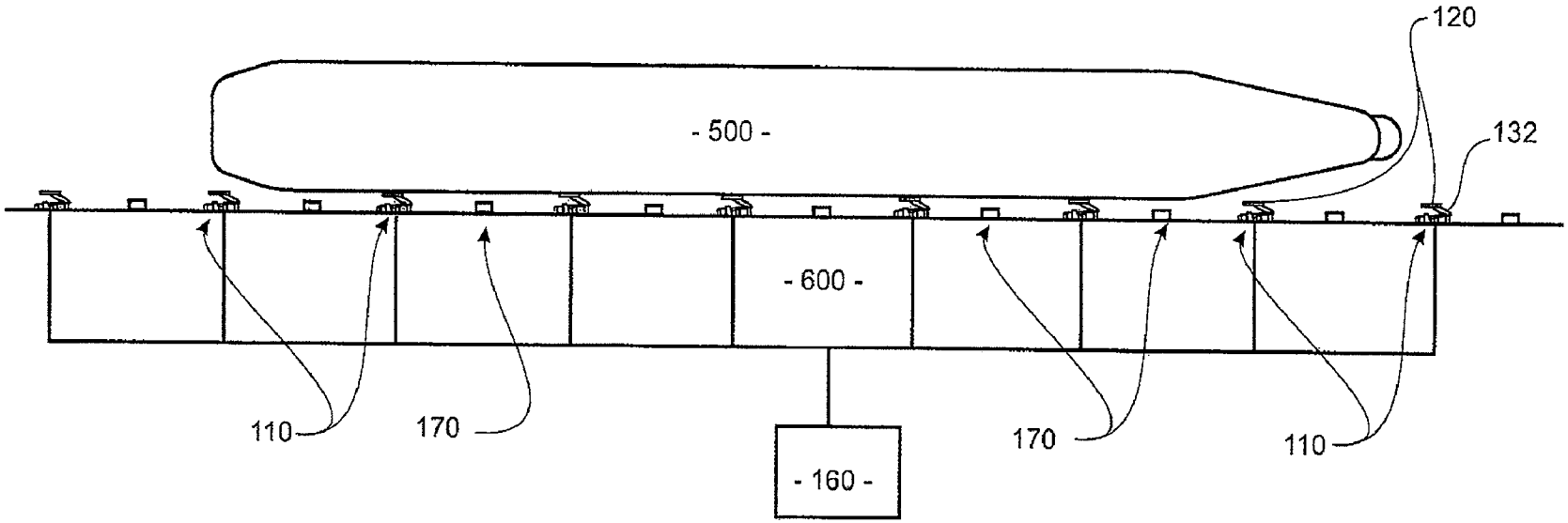
FIG. 3 shows the vessel having been brought to a halt and moored.

In one embodiment shown in FIGS. 1-3, the control system 160 is centralised, so that all of the mooring robots 110 can be controlled by the control system 160 according to the location and approach velocity of the vessel 500 in relation to each of the mooring robots 110.

However, in another embodiment, the sensor(s) may only transmit sensed information to a local control system 160 for a single mooring robot 110, so that the actions of that mooring robot alone are controlled. In this way, each individual mooring robot may operate independently.

Figure 5:
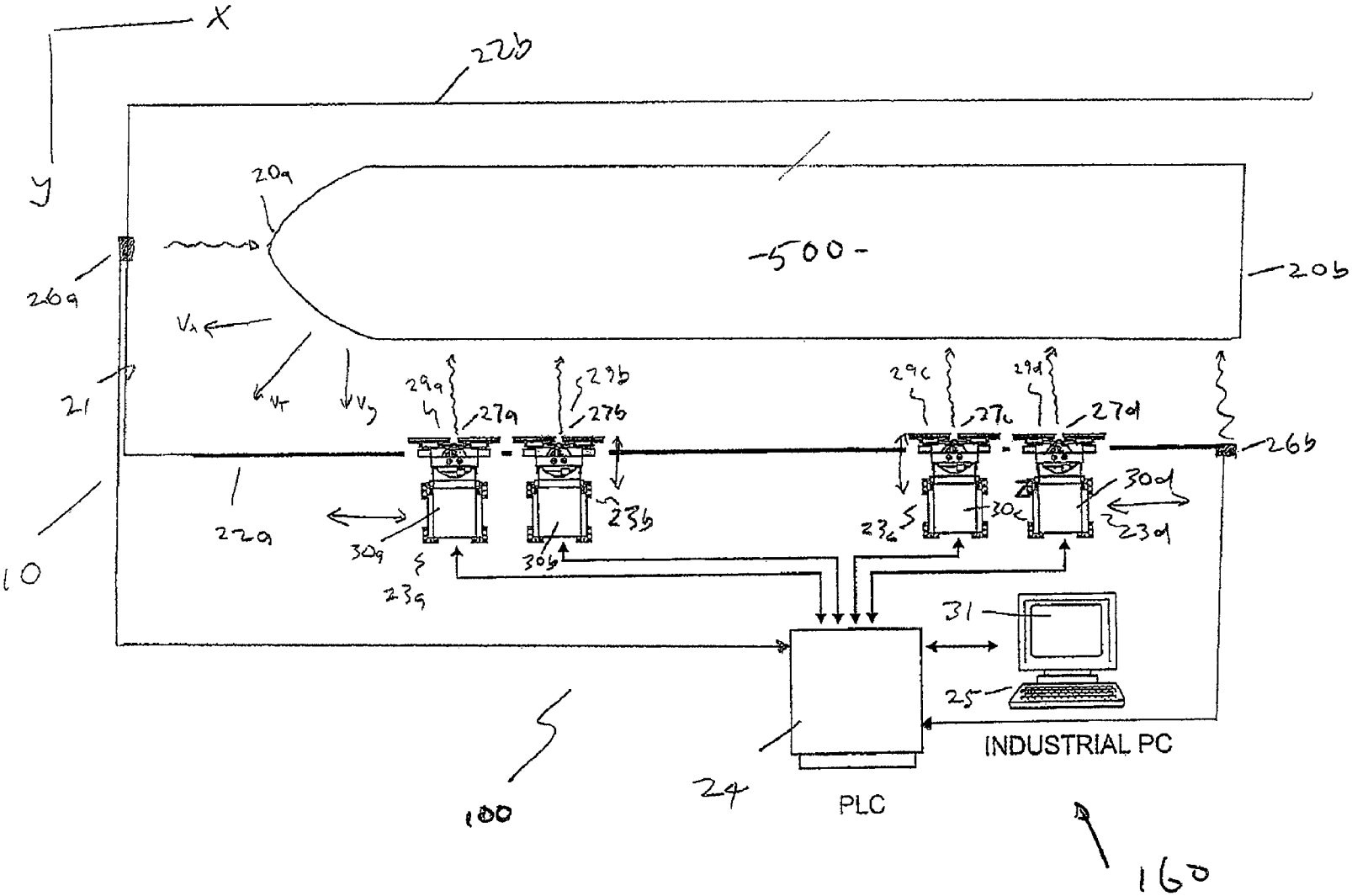
FIG. 5 shows a vessel approaching a mooring system.

FIG. 5 shows further detail, in schematic plan view, of a mooring facility 10 such as a roll-on roll-off terminal. Sensing of the position and/or velocity of a vessel 500 as it approaches the mooring facility 10, and operation of the mooring system 100 in accordance with the sensed information can occur. As shown in FIG. 5, the roll-on roll off facility 10 comprising two lateral sides 22*a*, 22*b* and an endwall 21. A plurality of mooring robots 23*a*-23*d*, sensors 26*a*, 26*b*, 27*a*-27*d*, and a control system 160. The control system 160 can comprise, for example, a computer 25 and programmable logic controller (PLC) 24.

Each mooring robot 23*a*-23*d* comprises one or more hull couplers 29*a*-29*d*, such as suction or suction cups. A rig 30*a*-30*d* may hold the cups in a movable manner relative to the dock.

The mooring robots 23*a*-23*d* may be like that shown in FIG. 4 or of a kind as shown with respect of FIGS. 7 and 8 or similar.

Each mooring robot 23*a*-23*d* may have an associated sensor 27*a*-27*d* for sensing, at a plurality of instants, the distance of the vessel from the respective mooring robot. In particular the distance between a contact zone on the vessel and the suction cup is one measurement being measured.

Where the invention is executed at a Roll-on Roll-off facility for example, a sensor 26*a* may be positioned on the end wall 21 to measure the distance from the end 21 to the bow 20*a* of the vessel or stern of the vessel, whichever is closest. A sensor 26*b* may also be placed at a location of the mooring facility to determine the distance from the facility 10 to the other end of the vessel such as stern 20*b* of the vessel or the bow of the vessel as the case may be.

The sensors can for example measure the distance at multiple points in time, and therefore obtain a measure as to the change in distance due to movement of the vessel and/or part of the vessel over time. From this, the position and/or change of position of the vessel can be determined for both the x and the y axis displacements. This can provide a Cartesian coordinate determination of at least one of the position and the speed and the velocity of parts of and/or the entire vessel relative to the mooring facility.

At each instance where the position and/or the velocity of the vessel is determined, the controller may pass this information directly or indirectly to an output device. For example, it may pass the information to a PC 25 that uses the information to provide output to a user on a screen 31.

Sensors could be used to not just measure the position and/or velocity of the vessel, but also of part or parts of the vessel. For example if the vessel is turning, the velocity of the bow and the stern relative to the mooring facility can be different. The sensors could be used to let information about the position and/or velocity of the bow and stern of the vessel to be provided and used. Or of any other parts of the vessel such as those parts that are proximate most the mooring robot or each mooring robot.

Figure 6:
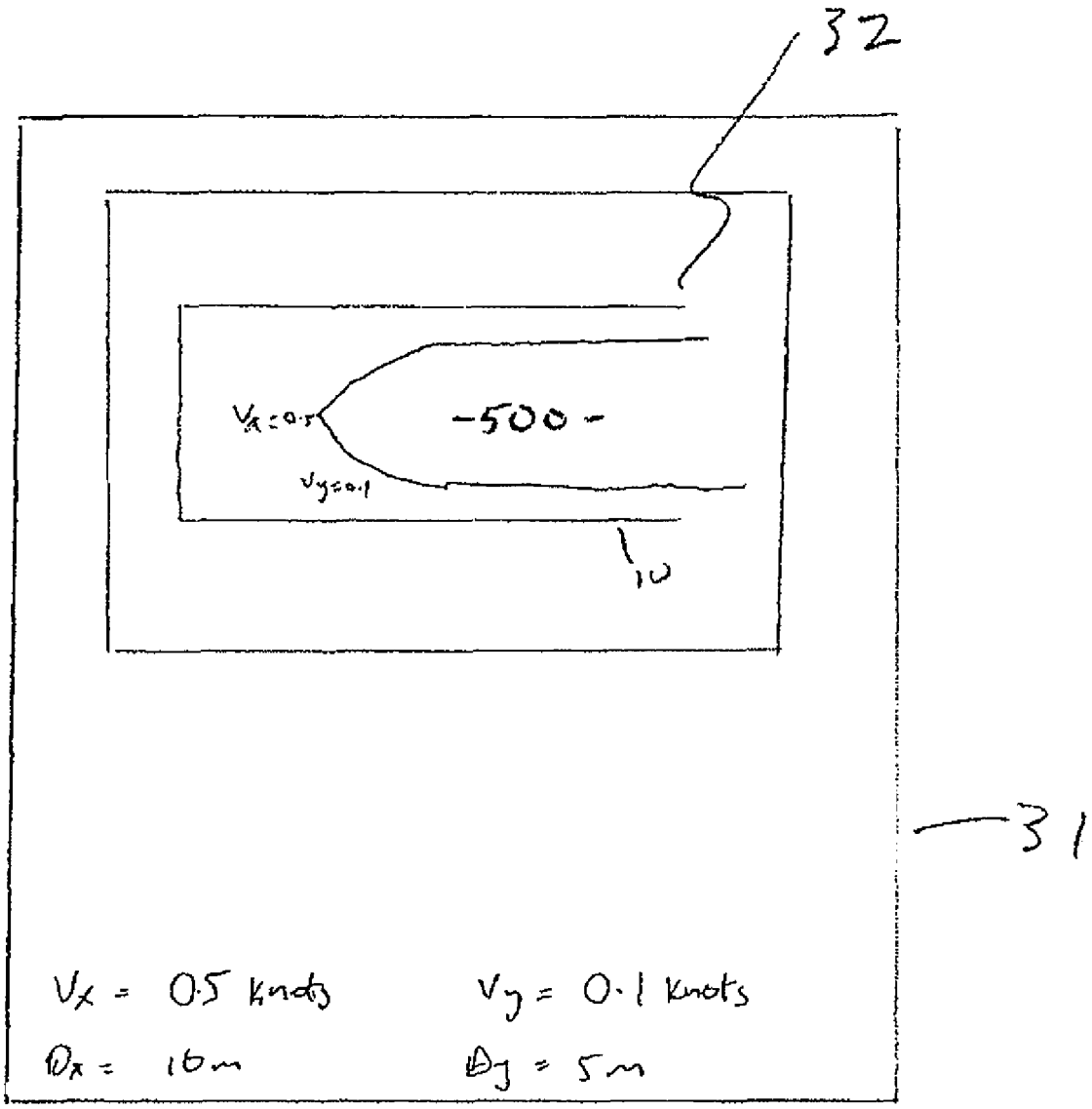
FIG. 6 shows an output device giving graphical information regarding the position and/or velocity of an approaching vessel.

FIG. 6 shows, in schematic form, the information that may be provided on the visual output device 31. In the preferred embodiment, a graphical representation 32 of the vessel 500 and its positional relationship to the mooring facility 10 is displayed. This graphical representation may be continually updated or animated, such that movement of the vessel 20 and its relative velocity will also be shown. Velocity of multiple parts of the vessel may also be displayed.

Information on change in velocity (eg acceleration of deceleration) of the vessel and/or part of parts of the vessel may be generated. This information may be displayed and/or otherwise used.

The information may indicate to an operator at the mooring facility 10 and/or onboard or viewable from onboard the vessel, the position and/or velocity of the vessel 500 and/or part or parts of the vessel without having to view the vessel directly. This can assist the operator to control and operate the mooring system 11 in an appropriate manner.

A visual output device 31 might provide an indication of the vessel position in plan view (eg. as coordinates or a distance from a datum) and/or the vessel velocity. This indicates at least to the operator(s), information that enables them to make decisions in relation to the operation of the mooring system.

Figure 9:
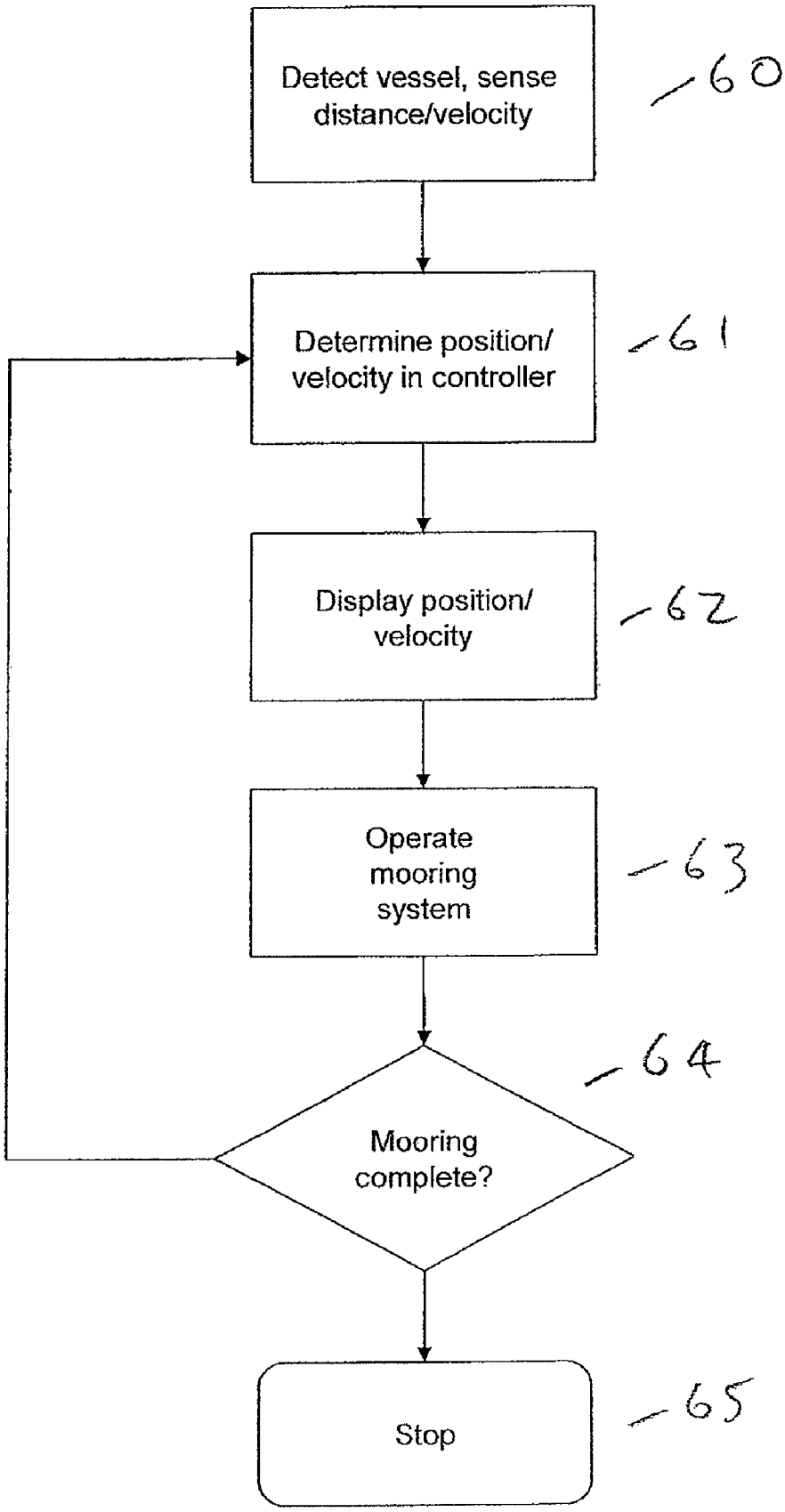
FIG. 9 shows a method according to the present invention.

FIG. 9 shows steps the system can perform prior to contact between a vessel and the suction cups. The system can detect the vessel and sense distance and/or velocity via the sensors (step 60). This information is obtained continually or periodically. The position of the vessel is sensed then passed to the controller 160 to determine the position and the velocity of the vessel in the x and y directions, step 61. The controller may then process this information for direct display, step 62, or communication in another fashion to an operator, such as described in relation to FIG. 6.

The operator can view the position and velocity of the approaching vessel on the display, and from that information operate the mooring system. This may include controlling velocity and position of the robots in the x, y and z direction to effect coupling to secure the vessel in an effective and safe manner.

Based on this information, the operator may opt not to operate the mooring system and not secure the vessel, if it appears dangerous to do so. For example, the position of the vessel might not be correct or the velocity of the vessel might be too high.

Further, the controller may trigger an audible or visual warning if the approaching vessel's velocity exceeds a threshold. For example, if the velocity exceeds 5 knots, a warning may be issued to the operator indicating that the mooring system should not be operated to secure the vessel, as the vessel's velocity may damage the system. This may alternatively be automated.

Through the control system 160 the position and/or velocity of the suction cups can be controlled prior to attachment to the vessel hull in order to move them into an appropriate position such as for coupling to the hull and/or move the robots during initial contact with the robots based on the position and/or velocity of the approaching vessel.

In this respect, the mooring system 100 may be actuatable between an activated condition in which the sensing system is operable and the mooring robots 110 are in an armed mode. In the armed mode the robots may be controlled for movement taking into account the sensed distance, speed, kinetic energy and/or acceleration/deceleration of the approaching vessel. In an unarmed mode the mooring robots are not in a state ready for operative engagement with a vessel but may have their sensors turned on to be able to detect vessels approaching. In a deactivated mode the mooring robots may have the sensing system turned off or in an other condition where it will not sense the approach of a vessel 500.

In one embodiment, the mooring system 100 is manually actuatable between active and de-active states.

The mooring system may comprise a set of movement calculating instructions for each mooring robot based on information from the sensing system. This may be embodied in the form of software operable on a computer.

The set of movement calculating instructions can be embodied by software which is configured for instructing a processor.

The generated location signal may be used for calculating two index values.

The first index value is indicative of the movement required of the mooring robot 110 in order to engage the suction cups with the vessel 500 without causing significant initial change in inertia of the vessel 500 (i.e. without it hitting the suction cups hard, thereby damaging either the vessel 500, the terminal 600 or the mooring robot 110).

The movement calculating instructions may also calculate a second index value or set of index values indicative of the movement required of the mooring robot 110 in order to reduce speed of the moving vessel 500 to preferably substantially bring the vessel to a halt. Again, preferably without any sudden deceleration.

Preferably control is exercised over the vessel by a or each mooring robot in a way to prevent damaging collision of the vessel with the terminal 600 and/or the mooring robot 110.

The second index may also provide instructions for the operational condition or conditions in which the mooring robot needs to be in, during initial contact and/or after initial contact with a vessel. Such is preferably in order to allow the operation of the mooring robot to occur, during the mooring of a vessel, in a manner that prevents damage to the vessel, mooring robot(s) and/or terminal. For example, a large force may need to be exerted on the approaching vessel in order to bring it to a halt. This may require the suction pressure and the hydraulic pressures to be set at a maximum.

The movement calculating instructions may also include calculation to determine if a mooring robot can be placed in a condition to safely engage with a vessel during the mooring procedure. It may be that the movement range required to bring the vessel to a halt is beyond that which the mooring robot is able to handle. It may be that in concert with the other mooring robots that are to engage with the vessel, the mooring robot can not be operated safely to bring the vessel to a halt. This may result in the mooring robot being moved to a condition, isolating it from contact with the vessel.

However, it may also result in contact being established to help reduce the velocity of the vessel. Such contact may be temporary as release from contact may be needed if for example the limit of travel of a suction cup is reached.

The control system 160, may include a controller connected to switches for actuating mooring robots condition and/or position change in accordance with the index(es).

The control system 160 may control the movement of the mooring robots 110 in accordance with the directions derived from the movement directing instructions. The processor can be a dedicated processor (typically in a computer) installed particularly for the mooring system, or it may be typically present as part of other systems present on the terminal and/or vessel. Similarly, the software instructions will typically be stored on a storage means such as digital storage means in the form of a computer hard disk, chip or the like.

The movement calculating instructions and movement directing instructions may use differentials of the location signal in directing the processor to calculate the indexes and directing the controller to control the movement and/or condition of the mooring robot. In particular, the movement calculating instructions and movement directing instructions can use one or more selected from the velocity of the vessel relative to the terminal,
the acceleration or deceleration of the vessel,
the kinetic energy of the vessel, and
the inertia of the vessel.

Some or all of this information can then be used in calculating an index indicative of the movement required of a mooring robot in order to engage the suction cups with the vessel without causing significant initial change in inertia of the vessel; calculating an index indicative of the movement required of the mooring robot in order to further stop the moving vessel without it undergoing a sudden deceleration; and/or activating the mooring system to an active state. The active state may be variable. For example if a large vessel is approaching or if the energy needed to bring the vessel to a stop is large, the mooring robot may be put in a state that can absorb such energy, which may be a different state if the vessel is smaller or travelling less fast.

In calculating the kinetic energy or inertia of the vessel, the movement calculating instructions and movement directing instructions can use combinations of the velocity or acceleration of the vessel together with known mass and size figures for the vessel which are input by an operator, or these figures can be obtained from known information systems, such as AIS.

It is envisaged that the engaging mechanism 120 at the end of the arm linkages 132 of the mooring robots 110 will be extended to their maximum range outwardly towards the approaching vessel 500. Just before the vessel 500 makes contact with the engaging mechanism 120, the arm linkages 132 may start moving the engaging mechanism back inwardly towards the terminal 600 (and/or along the terminal), at a velocity slightly less than that of the approaching vessel 500, so that the vessel 500 engages with the engaging mechanism 120 while the extendable arm linkages 132 are still at a large part of their extension capacity. The result of this movement will be that the vessel 500 is engaged with the engaging mechanism 120 without a significant change in inertia of the vessel 500, so that it is not subject to a shock which may cause damage to the mooring robot 110 and/or the vessel 500. Alternatively the robot may be in a passive mode with initial contact causing movement by the vessel of the engaging and moving mechanism whereupon it then activates for active control.

In a preferred embodiment, the mooring system 100 may include a plurality of emergency buffer elements 170 associated with each mooring robot 110. These emergency buffer elements 170 are suitable for absorbing the energy of an approaching vessel 500 which has kinetic energy or velocity that is in excess of that absorbable by the mooring robots 110. Thus the emergency buffer elements 170 provide additional emergency protection for the vessel 100, terminal 600 or mooring robot 110. It is envisaged that the emergency buffer elements 170 are moveable between a non-deployed position in which they do not obstruct normal operation of the mooring robot 110, and a deployed position suitable for protecting one or more of the terminal 600, the vessel 500, and the mooring robot 110. Typically, the emergency buffer elements 170 are retained in the non-deployed position, and move automatically to their deployed positioning in the event of an emergency situation being detected. Such a situation would typically be when the kinetic energy, the approach velocity, and/or the inertia of an approaching vessel 500 is above a predetermined threshold for that vessel 500. Again, AIS can be used in determining the mass of that vessel 500 when calculating its kinetic energy or inertia (since these are proportional at least partly to that vessel's mass).

In a preferred embodiment, the emergency buffer elements 170 operate by means of energy absorption systems such as airbags or the like, so that the emergency buffer elements 170 can move to their deployed position rapidly. However, the emergency buffer elements 170 can also be composed of timber or resilient material such as rubber. The primary direction of travel of the vessel, in which the system operates in relation to the buffer elements, is one parallel to the forces applied by the suction cups to the vessel. This is because the buffers can best help arrest athwartship direction movement of the vessel rather than fore/aft movement.

In a preferred embodiment the mooring robots 110 include wheels that are mounted on rails on the terminal. In such a way the mooring robots are moveable along the terminal 600. It is envisaged that the mooring robots 110 can be remotely controlled to move along the terminal 600, and may be self driven by their own independent driving mechanism, such as an engine and transmission or electric motor or the like. In yet another embodiment, the mooring robots may be moved by winches and winching cables attached to the either end of the mooring robots 110.

In another embodiment, the mooring robots 110 need not be rail mounted, but could have normal rubber wheels and can be driven by an operator like a vehicle. The mooring robots can be independently driven (preferably controlled by operators) to new positions along the terminal 600, according to the size of the vessel 500 to be moored and moored.

It is envisaged that the repeated collision of the suction cups 122 of the mooring robots 110 with the vessels could cause excessive abrasion of the suction cups 122. For this reasons, the mooring robots 110 may be provided with a protective member 264 for protecting the suction cups 122 from abrasion against the vessel 500 when the engaging mechanism 120 engages with the vessel 500. The protective member could be of a variety of shapes and sizes, and is moveable between a protective position (as shown in FIG. 4) in which the suction cup 122 is protected from abrasion by the vessel 500, and a retracted position in which it can engage with and secure against the vessel 500. Typically, the protective member would extend further than the engaging suction cups when in the protective position. It may be composed of an abrasive resistant material, such as hard rubber, or the like. The protective member would typically be moved to the protective position when the engaging mechanism is engaging with the vessel 500 to moor it, but would move to the retracted position when the engaging mechanism is securing to the side of the vessel 500 to moor it.

When the protective member 264 is used, the mooring robots may not provide or provide very little resistance to movement of the vessel in the athwartship direction (eg a direction perpendicular to the normal of the suction forces of the suction cups. The system may then only control the mooring robots in a manner to take into account athwartship direction movement of the vessel. Slippage in a fore/aft direction of travel of the vessel, between the vessel and the mooring robots may be permitted. The protective members may be wheels that prevent the hull of the vessel from being scratched during any such slippage and from the suction cups being damaged.

Once the vessel 500 has been brought to a halt, the protective member can be moved to the retracted position, allowing the suction cups 122 to make contact with the side of the vessel 500, allowing it to secure to the side of the vessel 500 by suction, thereby mooring the vessel 500 to the terminal 600. The mooring robots 110 can then be moved, together with the secured vessel, to a preferred position or configuration.

Where the mooring robots are also to help arrest movement in the fore/aft direction, the protective members are not used. In the configuration of mooring facility shown, a coupling of the suction cups with the vessel is necessary to help arrest the movement in the fore/aft direction. The normal direction suction force will determine the shear direction coupling force capacity between the vessel and suction cups which can be used in the calculations as needed.

Once the vessel 500 has engaged gently with the engaging mechanism 120, the controller controls the extendable arm linkages to slow the velocity of the vessel 500 towards and/or along the terminal 600 to a stop within the remaining arm linkage 132 travel distance. The vessel will be brought to a stop smoothly and with appropriate deceleration, so as to prevent shocks to the vessel 500 or mooring robot 110. To a large degree the kinetic energy of the vessel may be absorbed via the hydraulic system such as hydraulic cylinders 134 of the mooring robots. Fore/aft movement of the vessel can be arrested or reduced by the mooring robots in a mode of operation of the system where no protective members are utilised. Initial movement in such a direction by the suction cups during initial contact may also be controlled to ensure connection occurs without sliding or significant sliding between the vessel and the suction cups. Once engaged to the vessel, the fore/aft movement and/or athwartship movement may be arrested. Any up and down movement of vessel at where the suctions cups are engaged may not be restricted by the mooring robots, eg the suction cups may be able to freely move up and down.

The suction cups may be mounted on horizontal rails on the mooring robots to enable their movement along the dock to correspond with fore and aft movement of the vessel. Such movement of the suction cups may be controlled by hydraulic rams or any other appropriate actuation means.

In addition, the system may control a plurality of mooring robots in concert. For example, if the vessel is approaching in a manner where the side of the vessel is not parallel the linear array of mooring robots on the wharf, the array of robots may position their suction cups to correspond with the side of the vessel such that all suction cups engage at substantially the same time. This may occur to avoid any one or more robot engaging before the others and potentially overloading that one robot. This will also help in ensuring the maximum total force can be applied simultaneously to the vessel by all the mooring robots during the mooring of the vessel.

Alternatively, it may be that the system controls the mooring robots in a manner such that one or more mooring robots engage before others in the array. Mooring robots with the largest capacity to help arrest movement may engage earlier than others. For example, if a vessel is approaching at an angle, mooring robots at the most proximate part of the vessel may first engage. This initial contact may encourage at least a partial reduction in the speed of the vessel and may also help move the vessel to a condition more parallel to the array and wharf, eg, the vessel may be rotated as a result of the said contact.

If the approaching vessel has a velocity which exceeds a predetermined threshold, or a predetermined threshold for that vessel 500, the emergency buffer elements 170 may be automatically moved to the deployed position to assist in cushioning the shock to the mooring robot 110, vessel 500 and/or terminal 600.

The mooring system may also be operated in a manner to recruit more mooring robots if the system decides or indicated that such may be necessary.

For example if a vessel of a larger mass is approaching compared to a vessel previously at the mooring terminal, it may be necessary to have more mooring robots present to (a) help arrest movement of the vessel and/or (b) held moor the vessel after initial mooring. With mooring robots mounted on rails for example, such recruitment can be simply facilitated. Likewise a discharge of robots from the array of robots to receive the vessel may be facilitated. Also, it is envisaged that a discharge of robots from the array may occur, once the mooring process is complete. During mooring more robots may need to be part of the array to help arrest the vessel, but not all in the array may be needed to keep the vessel moored after initial mooring.

As can be seen one of a number of actions or operations can take place automatically, by the controller and/or by the operator, (eg at step 63) dependent on the position and/or velocity of the incoming vessel. These may be carried out until mooring is complete, step 64. These operations are as follows.

A number of alternatives to the embodiment described above are possible. For example, it is not essential to have sensors on all the mooring devices. There could simply just be one or two sensors positioned appropriately either on the mooring facility and/or one or more of the mooring devices in order to obtain the appropriate distance information, from which position and ultimately velocity of the vessel can be determined. Having sensors on the mooring facility and on all the mooring devices is preferable, as this provides distance information relative to the mooring facility and also the moving mooring devices.

The present invention may utilise a mooring device that may be of a kind described in PCT International Application No. PCT/NZ02/00062. The description of the mooring device(s) in PCT/NZ02/00062 is hereby incorporated by reference.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope or spirit of the invention.

In addition, where features or aspects of the invention are described in terms of Markush groups, those skilled in the art will recognise that the invention is also thereby described in terms of any individual member or subgroup of members of the Markush group.

What is claimed is:

1. A mooring system, suitable for mooring a vessel moving relative to a terminal by at least one mooring facility mounted mooring robot that includes an engaging mechanism actuatable to engage with a vessel and a moving mechanism for moving the engaging mechanism relative to said mooring facility and at least one or more emergency buffer elements suitable for absorbing the energy of an approaching vessel with kinetic energy which is in excess of that absorbable by the mooring robots in a direction toward the mooring facility, thereby to provide additional protection for the vessel, mooring facility and/or mooring robot, the emergency buffer elements being movable between a non-deployed position and a deployed position; said mooring system comprising;

a) a location sensing system suitable for sensing the location of a vessel and generating a location signal corresponding to the sensed location of the vessel;

b) movement calculating instructions for instructing a processor to use the generated location signal for calculating an index indicative of the movement required of at least one mooring robot in order to engage the engaging mechanism of said at least one mooring robot with the vessel without causing significant initial change in inertia of the vessel;

c) movement directing instructions configured for directing a control system to control the movement of the mooring robot and the emergency buffer element(s) in accordance with the calculated index(es);

d) wherein one or more selected from the movement calculating instructions and the movement directing instructions utilises the location signal to direct the processor to calculate an index indicative of one or more selected from;

the velocity of said vessel relative to the terminal,
the acceleration or deceleration of said vessel,
the kinetic energy of said vessel, and
the inertia of said vessel; and e) wherein the movement directing instructions are configured to direct the control system to move the emergency buffer element(s) to their deployed position upon detection, via the location sensing system and/or the mooring robot(s), that the vessel's kinetic energy is greater than what can be absorbed by the mooring robot(s).

2. A mooring system as claimed in claim 1 wherein the movement calculating instructions are also for calculating an index indicative of the movement required of at least one mooring robot in order to smoothly transition the application of forces between the vessel and the mooring robot in at least a direction of movement of the vessel towards the mooring facility.

3. A mooring system as claimed in claim 1 wherein the mooring system includes movement directing instructions configured for directing a control system to control the movement of said at least one mooring robot in accordance with the calculated index(es).

4. A mooring system as claimed in claim 3 wherein the movement directing instructions are configured for directing at least one mooring robot to engage with and interact with the vessel to reduce its kinetic energy.

5. A mooring system as claimed in claim 3 wherein the mooring system includes a control system for controlling movement of the moving mechanism in accordance with that directed by the movement directing instructions.

6. A mooring system as claimed in claim 1 wherein the movement directing instructions are configured for directing at least one mooring robot to extend the engaging mechanism away from the mooring facility and towards the approaching vessel, and then retract the engaging mechanism towards the mooring facility at a velocity smaller than the velocity of the approaching vessel in that direction so that the vessel makes initial contact with the mooring robot to thereby ensure smooth deceleration of the vessel to bring it to a halt.

7. A mooring system as claimed in claim 1 wherein the movement directing instructions are configured for directing a plurality of mooring robots of the mooring system that are arranged in an array at said mooring facility.

8. A mooring system as claimed in claim 1 wherein the movement directing instructions are configured for directing a plurality of mooring robots to provide an optimised array configuration for absorbing the kinetic energy of an approaching vessel in a manner to prevent a sudden change in force applied to a mooring robot by the said vessel.

9. A mooring system as claimed in claim 8 wherein the optimised array configuration includes the arrangement of the engaging mechanisms of the each mooring robot such that they all engaged with the vessel simultaneously.

10. A mooring system as claimed in claim 8 wherein the optimised array configuration includes the arrangement of the engaging mechanisms of the each mooring robot such that they all engaged with the vessel non-simultaneously.

11. A mooring system as claimed in claim 10 wherein the mooring robots are positioned in a linear array relative the mooring terminal and the optimised array configuration includes the arrangement of the engaging mechanisms in a manner that results in not all of the engaging mechanisms of each mooring robot engaging simultaneously with the vessel when the vessel, having a port or starboard side, is approaching the array with the port or starboard sides at an angle with respect to the array.

12. A mooring system as claimed in claim 10 wherein the optimized array configuration includes the arrangement of the engaging mechanisms of each mooring robot such that they are all engaged with the vessel sequentially.

13. A mooring system as claimed in claim 8 wherein the control system is configurable to actuate the engaging mechanism to engage with and secure the vessel to the terminal via the mooring robot(s) once the vessel has been moored.

14. A mooring system as claimed in claim 8 wherein the control system is configurable to actuate the engaging mechanism to engage with and secure the vessel to the terminal via the mooring robot(s), and to move the vessel to a predetermined configuration relative to the terminal once the vessel has stopped moving during initial mooring of the vessel.

15. A mooring system as claimed in claim 8 wherein the control system is configurable to actuate the engaging mechanism to engage with and secure the vessel to the terminal via the mooring robot(s) during initial mooring of the vessel to then exercise some control over the speed of the vessel in a direction towards the mooring facility and a horizontal direction perpendicular thereto.

16. A mooring system as claimed in claim 8 wherein the control system is configurable to actuate the engaging mechanism to engage with and secure the vessel to the terminal via the mooring robot(s), and to move the vessel to a predetermined distance relative to the terminal once the vessel has stopped moving during initial mooring of the vessel.

17. A mooring system as claimed in claim 1 wherein the moving mechanism includes at least one hydraulic cylinder, and kinetic energy of the approaching vessel is reduced by the flow of fluid through the hydraulic cylinder.

18. A mooring system as claimed in claim 1 wherein the mooring system includes a processor for performing calculations.

19. A mooring system as claimed in claim 1 wherein the mooring system includes at least one storage means for storing the movement calculating instructions or movement directing instructions or both.

20. A mooring system as claimed in claim 1 wherein the mooring system includes a transceiver for receiving and transmitting signals.

21. A mooring system as claimed in claim 1 wherein the location sensing system includes at least one Global Positioning System (GPS).

22. A mooring system as claimed in claim 1 wherein the location sensing system includes at least one localised distance sensing system and/or a localised positioning system.

23. A mooring system as claimed in claim 22 wherein the localised distance sensing system includes a distance sensor fixed relative to one of the mooring robot and mooring facility.

24. A mooring system as claimed in claim 1 wherein the mooring system includes at least one mooring robot.

25. A mooring system as claimed in claim 1 wherein the mooring system includes a plurality of mooring robots.

26. A mooring system as claimed in claim 25 wherein the control system controls each of the plurality of mooring robots to be controlled independently of each other.

27. A mooring system as claimed in claim 25 wherein the control system controls each of the plurality of mooring robots to be controlled independently of each other but operate in concert with each other.

28. A mooring system as claimed in claim 1 wherein one or more selected from the movement calculating instructions and the movement directing instructions is configured to receive information relating to the characteristics of said vessel to be moored.

29. A mooring system as claimed in claim 28 wherein the characteristics are one or more selected from unladen weight, laden weight, length, and any other characteristic of the vessel.

30. A mooring system as claimed in claim 28 wherein the mooring system is configured to receive information about characteristics of the vessel from the vessel's Automatic Identification System.

31. A mooring system as claimed in claim 28 wherein one or more selected from the movement calculating instructions and the movement directing instructions utilises the location signal to direct the processor to calculate an index indicative of one or more selected from;

a) the velocity of said vessel relative to the terminal, b) the acceleration or deceleration of said vessel, c) the kinetic energy of said vessel, and d) the inertia of said vessel.

32. A mooring system as claimed in claim 1 wherein the at least one or more emergency buffer elements are normally retained in their non-deployed positions, and move automatically to their deployed positions upon detection, via the location sensing system and/or the mooring robots, that the vessel's kinetic energy is greater than what can be absorbed by the mooring robot(s).

33. A mooring system as claimed in claim 1 wherein the mooring system includes a plurality of emergency buffer elements.

34. A mooring system as claimed in claim 1 wherein, when one or more of the calculated kinetic energy and inertia of an approaching vessel in at least a direction towards the mooring facility is above the energy absorption capability of the mooring robot or mooring robots when acting in concert, the movement directing instructions are configured for directing the mooring robot(s) to absorb as much energy of the approaching vessel as possible without being damaged, before withdrawing to a protected position in which the mooring robots are shielded from damage by the vessel by the at least one or more buffer elements.

35. A mooring system as claimed in claim 1 wherein the mooring system is configurable between an activated state in which the location sensing system of the system is operable to detect the location of an approaching moving vessel and control the mooring robot(s) in response to the detected location of the vessel, and a deactivated state in which the location sensing system is not operable.

36. A mooring system as claimed in claim 1 wherein the mooring system uses information received from an Automatic Identification Systems (AIS) of individual vessels to identify the approaching vessel and determine relevant information relating to that vessel.

37. A mooring system as claimed in claim 1 wherein the mooring system uses information received from the Automatic Identification Systems (AIS) of individual vessels to identify an approaching vessel and determine relevant information relating to that vessel, for use in one or more selected from;

a) calculating an index indicative of the movement required of the mooring robot in order to prevent significant initial transfer of forces between the vessel and the mooring robot on engagement of the vessel by the engaging mechanism;

b) calculating an index indicative of the movement required of the mooring robot in order to smoothly transition the application of forces between the vessel and the mooring robot to stop or slow the moving vessel without it undergoing a sudden deceleration; and c) activating the mooring system from an inactive state to an active state.

38. A mooring system as claimed in claim 1 wherein the engaging mechanism of the mooring robots includes a suction cup in fluid communication with a suction source, which allows the suction cup to attach to the hull of the vessel by suction force.

39. A mooring system as claimed in claim 1 wherein the engaging mechanism includes a protective member for protecting the suction cup from abrasion against the vessel when the engaging mechanism engages with the vessel during initial mooring of the vessel.

40. A mooring system as claimed in claim 39 wherein the protective member is moveable between a protective position in which the suction cup is protected from abrasion by the vessel, and a retracted position in which the suction cup can engage and secure with the vessel.

41. A mooring system as claimed in claim 1 wherein the moving mechanism includes at least one moveable arm linkage located intermediate of a foundation of the mooring robot that is mounted to the mooring facility and the engaging mechanism.

42. A mooring system as claimed in claim 1 wherein the moving mechanism allows controlled movement of the securing mechanism relative to the mooring facility.

43. A mooring facility that includes a mooring system as claimed in claim 1.

44. A method of mooring a vessel utilising at least one mooring facility comprising a location sensing system; emergency buffer elements movable between a deployed and a non-deployed position; and at least one or more mooring robots each comprising an engaging mechanism for engaging with the side of a vessel approaching a mooring facility, and a moving mechanism for moving the engaging mechanism, said method comprising the steps of;

a) measuring the location of a vessel relative to a terminal by way of a location sensing system;

b) calculating an index value indicative of the kinetic energy of the approaching vessel at least in a direction acting towards the mooring facility; and c) deploying said emergency buffer elements to their deployed position upon detection, via the location sensing system and/or the mooring robot(s), that a vessel's kinetic energy is greater than what can be absorbed by the mooring robots.

45. A method of mooring a vessel as claimed in claim 44 wherein the method includes the step of calculating an index indicative of the movement required of the mooring robot in order to move the vessel while smoothly transitioning the application of forces between the vessel and the mooring robot.

46. A method of mooring a vessel as claimed in claim 45 wherein the method includes the step of calculating an index indicative of the movement required of the mooring robot in order to slow the movement of the vessel towards the mooring facility without a sudden deceleration, thereby preventing damaging collision of the vessel with the mooring facility.

47. A method of mooring a vessel as claimed in claim 44 wherein the method includes the steps of directing a controller to control movement a mooring robot in accordance with the calculated index to bring the vessel to a stop without a sudden deceleration.

48. A method of mooring a vessel as claimed in claim 44 wherein the method includes the step of activating the location sensing system to sensitise it to the approach of a vessel.

49. A method of mooring a vessel as claimed in claim 48 wherein the step of activating the location sensing system is carried out automatically by the Automatic Identification System (AIS) of the vessel.

50. A method of mooring a vessel as claimed in claim 44 wherein the method includes the steps of extending at least part of engaging mechanism towards the approaching vessel, and then retracting the extended part at a velocity that is slower than the approaching vessel, thereby causing the approaching vessel to engage with the extended part without causing impact damage to the mooring robot and/or the vessel.

51. A method of mooring a vessel as claimed in claim 44 wherein the method comprises the steps of calculating an index associated with the movement required by the mooring robot to engage the engaging mechanism with the vessel in order to prevent significant initial transfer of forces between the vessel and the mooring robot on engagement of the vessel by the engaging mechanism when the index value indicative of the kinetic energy of the approaching vessel is smaller than what can be absorbed by the mooring robots.

52. A method of operating a mooring system suitable for receiving a vessel that is approaching a mooring facility that includes emergency buffer elements movable between a deployed and non-deployed position; a plurality of mooring robots mounted to a mooring facility, said mooring robots including an engaging mechanism for engaging with the side of a vessel and a moving mechanism for moving the engaging mechanism relative the mooring facility, said mooring robots forming part of a system that comprises;

a) a location sensing system suitable for sensing the location of and/or part of the vessel relative to the mooring facility and/or each of the mooring robots and/or each of the engaging mechanisms, b) and a processor for calculating movement required by the engaging mechanism of each mooring robot, and c) a controller to control movement of the mooring robots in response to information received from the processor, said method comprising the steps of;

d) providing movement calculating instructions for instructing the processor to use a generated location signal for calculating an index representative of the kinetic energy of the vessel; and e) configuring the instructions to direct the processor to use deploy the emergency buffer elements to their deployed position in the event that the calculated kinetic energy of the approaching vessel is greater than what can be absorbed by the mooring robot(s).

53. A method of mooring a vessel utilising at least one mooring facility mounted mooring robot that comprising an engaging mechanism for engaging with the side of a vessel approaching a mooring facility, and a moving mechanism for moving the engaging mechanism, said method comprising the steps of;

a) measuring the location of a vessel relative to a terminal by way of a location sensing system;

b) calculating an index value associated with the movement required by the mooring robot to engage the engaging mechanism with the vessel in a condition to allow control of movement of the mooring robot to reduce the kinetic energy of the vessel in at least a direction acting towards the mooring facility by the mooring robot, while resulting in the smooth transition in the application of force between the mooring robot and said vessel;

c) calculating an index indicative of the kinetic energy of the vessel;

d) instructing the deployment of emergency buffer elements to a deployed condition to shield the mooring robot in the event that the calculated index indicative of the kinetic energy of a vessel exceeds a predetermined threshold.

* * * * *